US008776583B2

(12) United States Patent
Marchetti

(10) Patent No.: US 8,776,583 B2
(45) Date of Patent: Jul. 15, 2014

(54) DEVICE COMPRISING AN AUTOMATED CABLELESS DILATOMETER

(76) Inventor: Diego Marchetti, Rome (IT)

( * ) Notice: Subject to any disclaimer, the term of this patent is extended or adjusted under 35 U.S.C. 154(b) by 431 days.

(21) Appl. No.: 13/194,762

(22) Filed: Jul. 29, 2011

(65) Prior Publication Data

US 2013/0028287 A1 Jan. 31, 2013

(51) Int. Cl.

| | |
|---|---|
| ***G01N 3/00*** | (2006.01) |
| ***E02D 1/02*** | (2006.01) |
| *G01M 3/02* | (2006.01) |

(52) U.S. Cl.

CPC ..... *E02D 1/022* (2013.01)
USPC ..... 73/84; 73/37

(58) Field of Classification Search

USPC ..... 73/37, 84; 367/14; 374/55
See application file for complete search history.

(56) References Cited

U.S. PATENT DOCUMENTS

| | | | | | |
|---|---|---|---|---|---|
| 3,148,538 | A | * | 9/1964 | Heerema | 73/84 |
| 3,210,990 | A | * | 10/1965 | Cantrell | 73/84 |
| 3,481,188 | A | * | 12/1969 | Hiroshi | 73/84 |
| 3,610,035 | A | * | 10/1971 | Handy et al. | 73/784 |
| 3,673,861 | A | * | 7/1972 | Handy | 73/841 |
| 3,690,166 | A | * | 9/1972 | Grice et al. | 73/84 |
| 3,872,717 | A | * | 3/1975 | Fox | 73/84 |
| 3,896,663 | A | * | 7/1975 | Ogura | 73/784 |
| 4,043,186 | A | | 8/1977 | Marchetti | |
| 4,149,409 | A | * | 4/1979 | Serata | 73/152.03 |
| 4,367,647 | A | * | 1/1983 | Barnoud et al. | 73/84 |
| 4,458,525 | A | * | 7/1984 | Lutenegger et al. | 73/84 |
| 4,539,851 | A | * | 9/1985 | Lutenegger | 73/845 |
| 4,543,820 | A | * | 10/1985 | Handy et al. | 73/84 |
| 4,662,213 | A | * | 5/1987 | Handy et al. | 73/37 |
| 4,760,741 | A | * | 8/1988 | Koopmans et al. | 73/784 |
| 5,540,101 | A | * | 7/1996 | Capelle et al. | 73/784 |
| 5,548,991 | A | * | 8/1996 | Ritson | 73/38 |
| 5,698,799 | A | * | 12/1997 | Lee et al. | 73/866.5 |
| 7,898,903 | B2 | | 3/2011 | Marchetti | |
| 2004/0237640 | A1 | * | 12/2004 | Meister et al. | 73/152.48 |

* cited by examiner

*Primary Examiner* — Daniel S Larkin
*Assistant Examiner* — Jamar Ray
(74) *Attorney, Agent, or Firm* — Novak Druce Connolly Bove + Quigg LLP

(57) ABSTRACT

An in situ device for soil investigation including a probe for inserting into and advancing into the ground, the probe including: at least one dilatometer presenting at least one expandable membrane, a chamber for fluid to be fed to the dilatometer and expand the membrane, a compression/pressure regulator unit connected to the chamber and dilatometer, to generate and/or regulate the fluid pressure, a control unit for the connector and the dilatometer, electrical powering unit to power the dilatometer, compression/pressure regulator unit, control unit, and a pressure measurement unit, unit for storing pressure values, measured by the measurement unit, for the fluid fed to said dilatometer. These components all housed within the probe. The probe being a closed body without connections to the outside for feeding pressurized fluid to the dilatometer and/or for feeding control signals for the device. The chamber being the only fluid feed source for the dilatometer.

18 Claims, 5 Drawing Sheets

DEVICE COMPRISING AN AUTOMATED CABLELESS DILATOMETER

FIELD OF THE INVENTION

Figure 1:
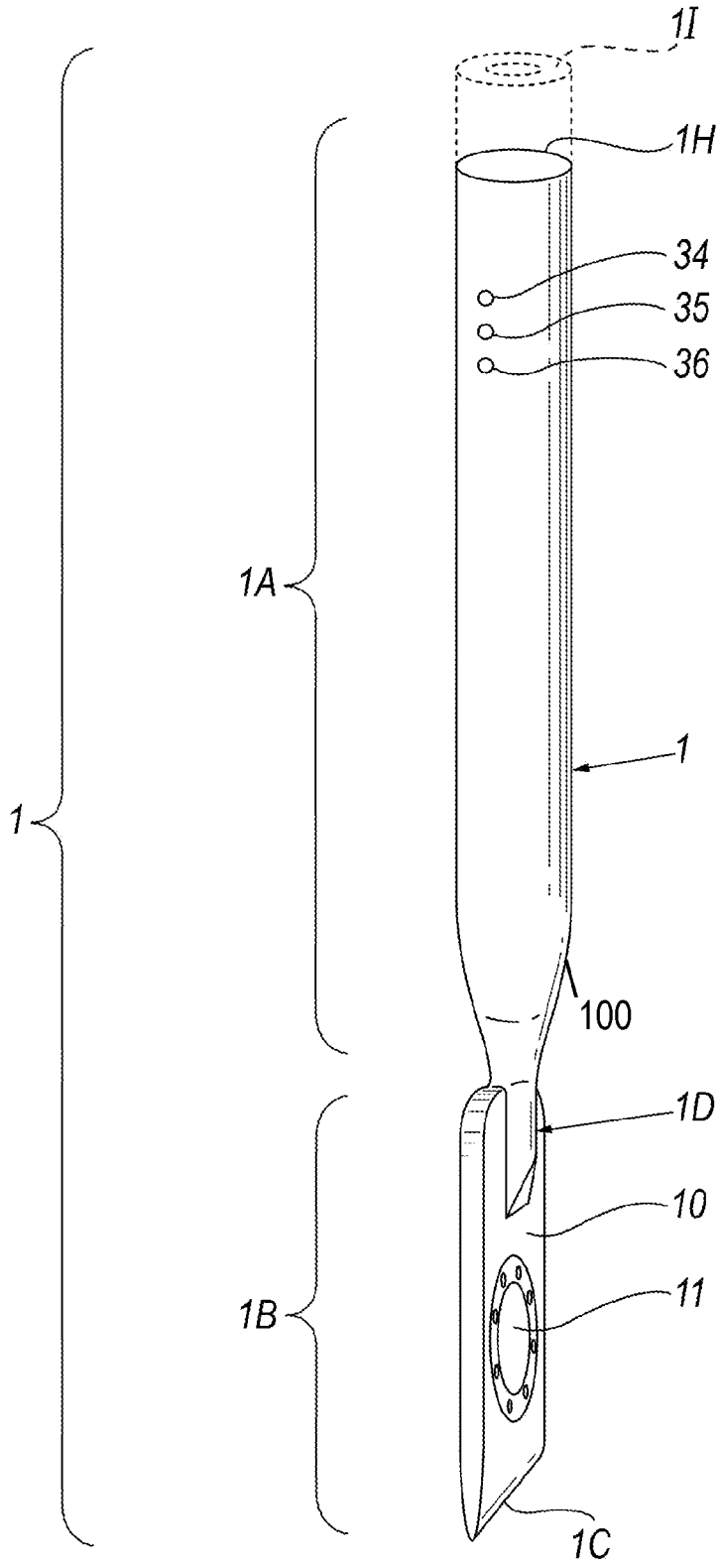

The present invention relates to a device, comprising a flat dilatometer, for the in situ measurement of soil properties.

The device can be used either on land or offshore to investigate soil layers below the seabed.

STATE OF THE ART

In the present context by flat dilatometer it is meant a conventional membrane instrument, in which said membrane is expandable by a pressurized gas, and which is used to measure soil properties. Flat dilatometers of the aforeindicated type are described for example in U.S. Pat. No. 4,043,186 and U.S. Pat. No. 7,898,903, the contents of which are to be considered as embodied into the present text.

These known dilatometers are mounted at the lower end of a drillstring, composed by a series of tubular steel rods, whose function is to advance the dilatometer to the required depths into the ground to be investigated. The dilatometer is connected by a plurality of cables (commonly known as "umbilical cables") housed in the tubular rods to a plurality of external devices housed outside the terrain to be examined, comprising, for example a control unit, an electrical powering unit, a pressurized gas unit, and others.

The tubular rods are advanced into the soil by known devices located outside the terrain to be examined.

The dilatometers are usually used with the following operating sequence:

s.1) the tubular rods are driven into the ground until the dilatometer reaches the first required depth;

s.2) at this depth, the dilatometer membrane is expanded by feeding gas at gradually increasing pressure, said membrane having one outer face in contact with the soil to be tested;

s.3) the control unit acquires at least two pressure values (of the compressed air and hence the reaction of the soil to be tested which opposes the membrane thrust). These pressure values represent the pressure at which the dilatometer membrane starts moving, thereby separating from a support element and the pressure at which the membrane has separated by a predetermined distance, for example 1.1 mm, from said support;

s.4) having measured at least these two pressure values, the membrane is returned to its rest condition by deflating the membrane;

s.5) the dilatometer is advanced to the next test depth and the sequence is repeated.

Known devices have proved difficult to be used in situations in which measurements are to be made at great depth or in the case of submerged terrains at great depth. In particular, hitherto it has not been possible to use known dilatometers to measure seabed terrains at great depth, for example 1000-2000 meters.

An object of the present invention is to provide a device for in situ soil testing on land, but also usable at great depth, and in particular on seabeds at considerable depth, for example at 1,000-2,000 meters or more.

SUMMARY OF THE INVENTION

This and other objects, which will be apparent to an expert of the art, are attained by a device in accordance with the characterising part of the accompanying claims.

The advantages obtained by the present invention will be more evident to the expert of the art from the following detailed description of one embodiment thereof, provided by way of non-limiting example and illustrated with reference to the accompanying schematic figures.

LIST OF FIGURES

Figure 2:
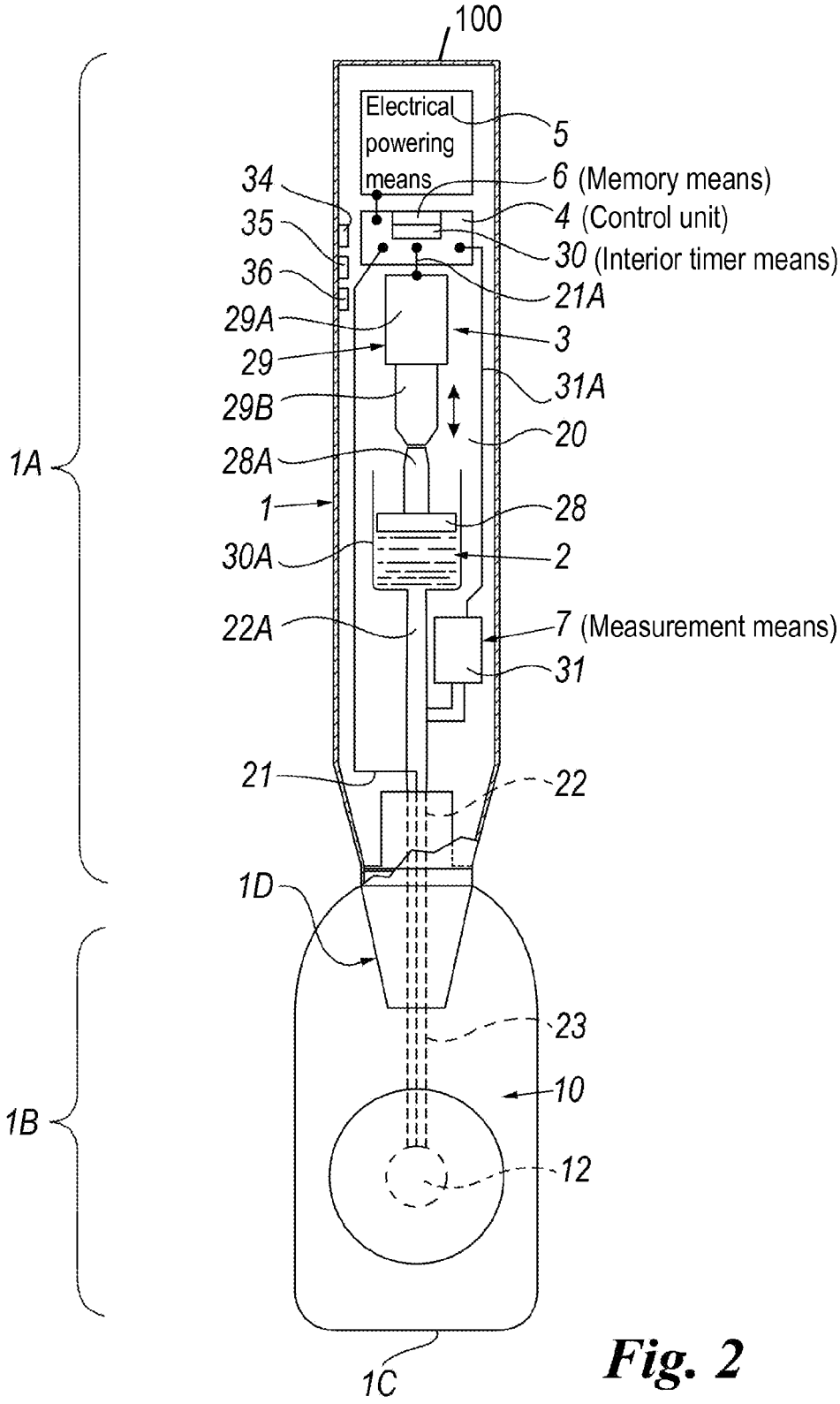
Figure 3A:
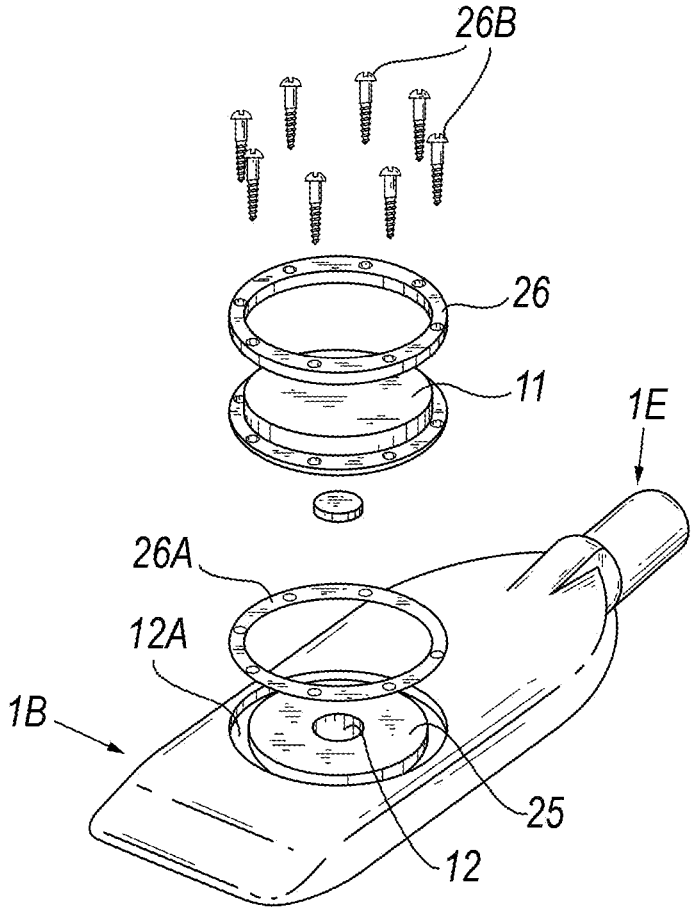
Figure 3B:
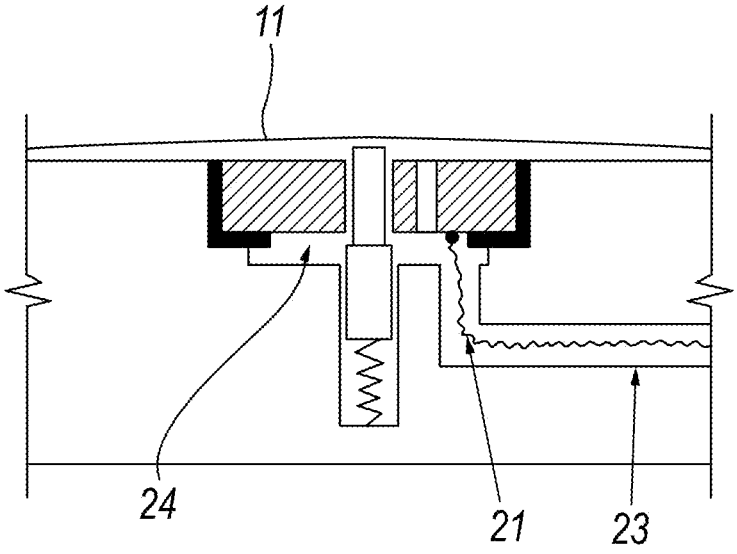
Figure 4:
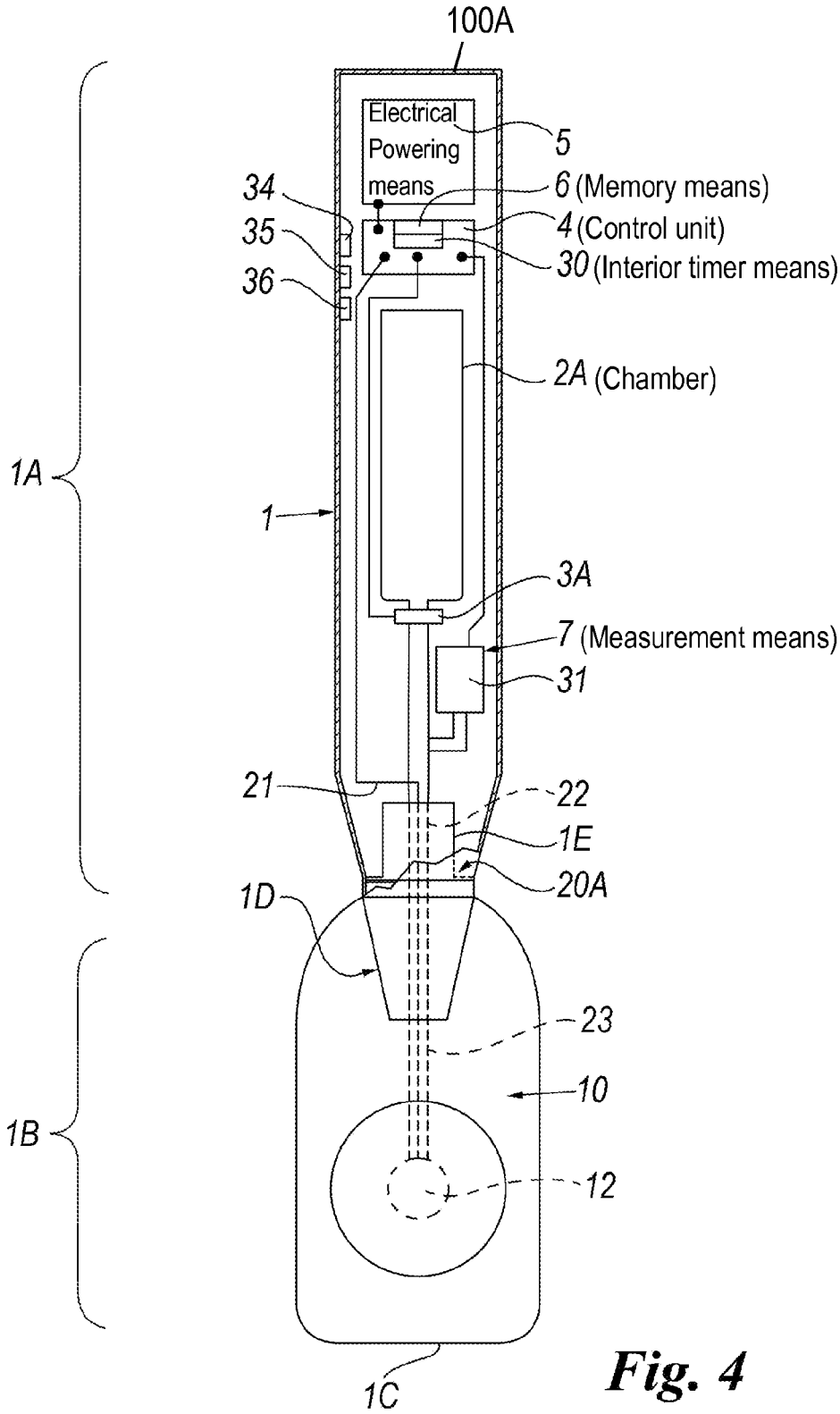
Figure 5:
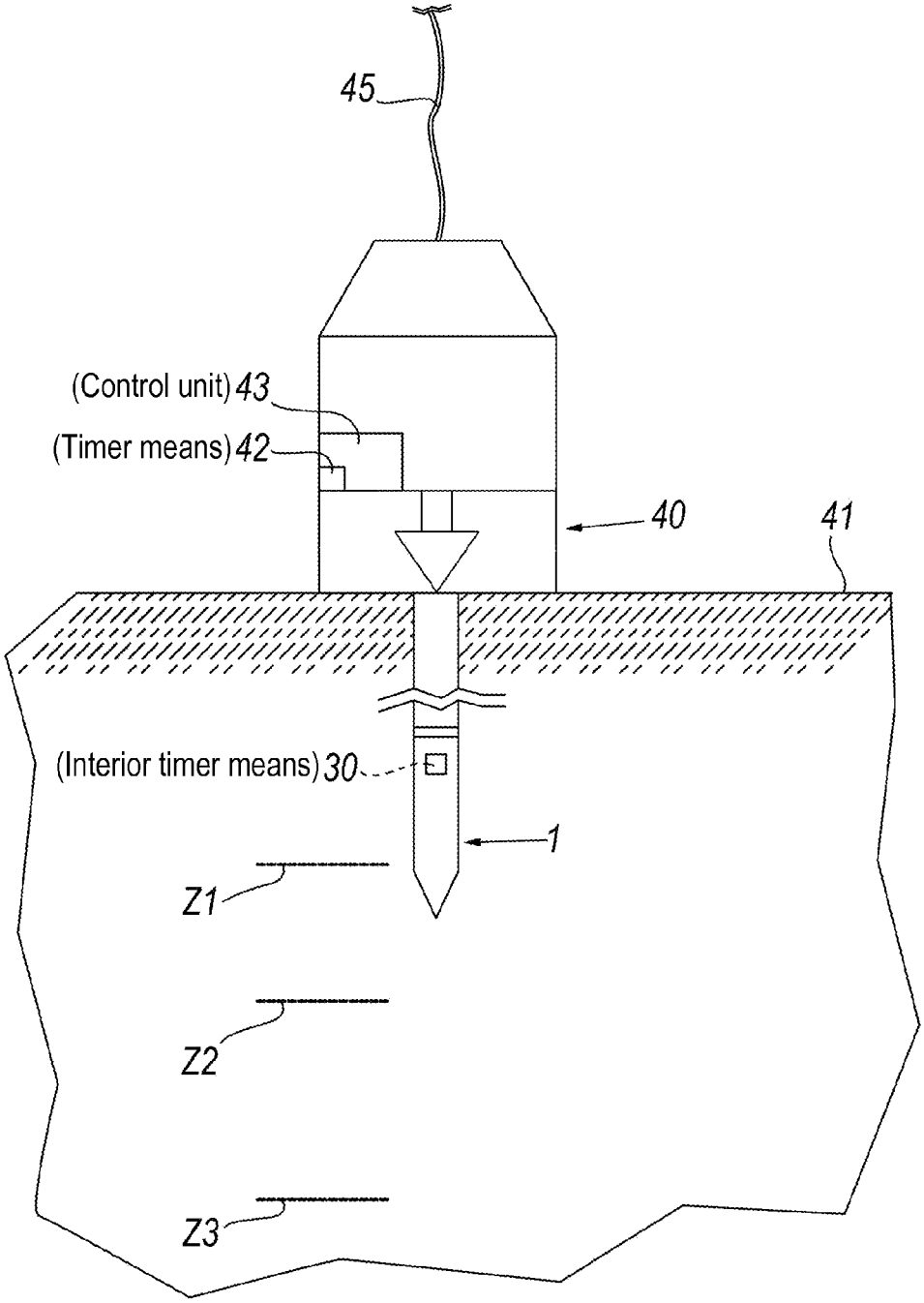

FIG. 1 is a perspective schematic view of a device according to the invention, FIG. 2 is a partly sectional schematic view thereof, showing the components and their interconnections, FIGS. 3A, 3B are a partly sectional exploded schematic view of one of the parts of the device, FIG. 4 is a partly sectional schematic view, similar to that of FIG. 2, of a variant of the device, FIG. 5 shows a measurement system comprising the measurement device of the preceding figures.

DETAILED DESCRIPTION

The device for the in situ measurement of soil properties comprises a probe 100 to be inserted into and made to advance through the-soil. This probe 100 comprises at least the following components:

- at least one dilatometer 10 presenting at least one expandable membrane 11,
- a chamber 2 for a fluid to be fed to said dilatometer and for said membrane to be expanded,
- means 3 connected to said chamber and to said dilatometer, to generate fluid pressure,
- a control unit 4 for said pressure generator and for said dilatometer,
- electrical powering means 5 to power said dilatometer, the compression means and the control unit,
- means 6 for storing at least one plurality of pressure values measured by said dilatometer,
- measurement means 7 for determining the pressure of the fluid fed to said membrane 11.

According to the invention, all the device components are housed within the casing 1; this latter is a closed casing without connection elements to the outside, i.e. without an "umbilical cord" for feeding electric current and/or for transferring electrical signals and/or for feeding the pressurized fluid to the dilatometer. The casing 1 preferably comprises only one opening 12 (FIG. 3) for connecting its interior to the outside, this opening being closed by the membrane 11.

In the represented embodiment, the casing 1 presents a cylindrical first part 1A and a second part 1B of flat plate form, terminating with a wedge-shaped portion 1C. Part 1A and Part 1B are connected together by a tubular connection and reinforcement element 1D.

According to the invention, the three parts 1A, 1B, 1C form a single body closed towards the outside. The cylindrical first part 1A preferably presents a cavity 20 to internally house all the device components with the exception of the dilatometer 10. The cavity 20 defines a chamber which is completely closed.

The part 1B preferably comprises a flat metal plate presenting a hole 23 (FIGS. 2 and 3B) which opens into a cylindrical cavity 24. The cylindrical cavity 24 is shaped to be able to house the usual dilatometer components and comprises the opening 12 closed by the membrane 11.

The shape of the cylindrical cavity 24 and of the components of the dilatometer 10 is conventional to the expert of the art, hence these elements will not be described hereinafter. The dilatometer 10 comprises the membrane 11 which, when in the rest condition, rests on a cylindrical pedestal 25. The membrane is secured to the edge of a recessed annular seat 12A by a ring 26 (and a gasket 26A) rigidly secured, for example by screws 26B, to the plate of the casing portion 1B. By means of conventional electrical contact members, the dilatometer is able to signal the position of the membrane 11, in particular it signals when the membrane is closed (in its rest position) or open (separation of 1.1 mm from the pedestal). The cylindrical cavity 24 defines a cavity closed by the membrane 11, into which the pressurized fluid is pumped from the chamber 2.

The cylindrical cavity 24 is connected to the chamber 2, through the hole 23, a hole 22 provided in the reinforcement element 1D and a tube 22A provided on the bottom of said chamber 2.

The control unit 4 is connected via electric cables 21 (FIGS. 3B and 2) to the dilatometer 10. The cables 21 preferably pass through a lower portion of a conduit 22A, and through conduits 22 and 23. Therefore preferably a portion of the cables is in contact with the pressurized oil.

The chamber 2 is of conventional type to the expert of the art and is able, for example, to contain a liquid such as oil. In order to generate and/or regulate the chamber fluid pressure, the chamber comprises means 3; 3A preferably in the form of a cylinder 30A, closed upperly by a piston 28 connected to a conventional driver member, for example a linear electrical actuator 29 apt to move the piston 28 within the cylinder 30A to hence pressurize the oil contained therein and to exert the desired pressure on the membrane 11 via the conduits 23, 22, 22A and the cylindrical cavity 24. The actuator 29 is connected via electric cables 21A (FIG. 2) to the control unit 4 and to the electrical powering means 5.

The actuator 29 is preferably of the type comprising an electric motor 29A and a worm 29B connected to the rod 28A of the piston 28.

The means 7 for measuring the pressure of the fluid fed to the dilatometer are provided downstream of the chamber 2. Said means preferably comprise a conventional pressure transducer member 31 arranged to generate an electrical signal representative of the measured pressure and feed it to the control unit 4 via an electric cable 31A.

The electrical powering means 5 are of conventional type to the expert of the art and comprise, for example, a usual rechargeable long life battery.

The control unit 4 is of the conventional type to the expert of the art and is preferably of the microprocessor type, the memory means 6 also being of the usual type and being advantageously integrated into the control unit.

Advantageously, the control unit comprises conventional synchronization means, enabling dilatometer operation to be activated only at predetermined times.

The device of the invention preferably comprises a plurality of apertures 34-36 (FIG. 1) for connecting a conventional on-off unit 34 (FIG. 2) for the device, a conventional inlet 35 for a recharging member for the powering means 5, and a port 36 for data exchange with the outside. The apertures 34-36 are usually sealed, for example, by threaded screws which engage in the apertures, plus relative gaskets.

The operation of the device of the invention is illustrated hereinafter.

In a first step, the device is penetrated into the terrain to the depth at which a first measurement is to be made, by conventional usual driver means (not shown) of the type known to the expert of the art. For this purpose, the top end 1H of the casing 1 comprises a threaded adaptor 11 (represented schematically in FIG. 1) permitting the connection to the tubular rods that advance the device.

The device advancement is halted and the pressurization means 3 for the fluid contained in the chamber 2 are activated in order to pressurize the membrane 11.

The control unit 4 acquires at least two pressure values for the compressed fluid, and hence for the soil, which counterbalances its thrust on the membrane 11, namely the pressure at which the membrane 11 initially separates from the pedestal 25 and the pressure at which the membrane 11 has separated by a predetermined distance, for example 1.1 mm, from this pedestal 25.

Once the center of the membrane 11 has moved the aforesaid predetermined distance, the control unit acts on the compression means 3 for the fluid in the chamber 2, to deflate it, i.e. to cause it to return to its rest condition.

The above operating sequence is repeated after again advancing the dilatometer to the next test depth.

According to the invention the device of the invention comprises in its interior timer means 30 (FIG. 2), preferably a conventional timer integrated into the control unit 4, to control membrane inflation/deflation.

Hence, according to the invention, the device is able at predetermined times, determined by the timer 30, to:

- control the compression means 3 for the pressurizing fluid in the chamber 2,
- measure the pressure of this fluid as a function of the position of the dilatometer membrane 11.

According to the invention, the device described up to this point is used in a measurement system which, in addition to said device, also comprises driver means 40 (FIG. 5) able to drive it and cause it to penetrate into the terrain and bring it to a plurality of predetermined test depths Z1-Zi According to the invention, this measurement system comprises at least two timer means: the first timer means are identical to those 30 already described and located on the measurement device, the second timer means 42 being instead installed on the driver means 40 for the device on which the dilatometer is mounted, and preferably integrated into the control unit 43 of these driver means.

Said first and second timer means are advantageously mutually synchronized, for example such that they both feed to the respective control units a signal relative to a shared time measurement, i.e. one and the same time signal (hours, minutes, seconds).

According to the invention, the measurement device memorizes those time periods in which the measurement device can be advanced and those in which this latter executes the test.

Consequently, once the driver means have brought the device to a first desired measurement depth Z1, or have driven it for a predetermined time period, said means are automatically stopped to maintain the measurement device at said first depth Z1 and then remain inactive for the period of time allocated to the measurement device for executing the test. Hence for example the driver means may drive the measurement device only during even minutes whereas during odd minutes this latter makes the test.

The measurement system and method described up to this point are particularly advantageous in determining the characteristics of seabeds lying at great depth (1000-2000 m deep). In this circumstance it has proved particularly advantageous to associate the measurement device with driver means 40 (FIG. 5) of the conventional type which, are lowered onto the seabed 41 by a single steel cable 45 and require no control and/or feed from the sea surface. Driver means of this type are for example ROSON 25/40 kN seabed penetrometer, manufactured by A.P. van den Berg (Heerenveen, Holland). As explained above, these Roson penetrometers must comprise timer means 42 synchronized with the timer means 30 mounted in the measurement device, to ensure the desired alternation between device driving periods and pressure measurement periods.

The measurement device can also be advanced with other known driver devices known to the expert of the art, such as wireline devices. Such wireline devices, frequently used in deep downhole investigations, use tools which are lowered to the bottom of the casing, for example by a metal cable, and may be arranged to push the measurement device into the ground at the bottom of the hole.

Finally, it should be noted that the aforedescribed embodiments are subject to various modifications and variations, but without departing from the scope of protection of the present invention. For example, the device could have a different form than that described, in particular for that portion 1B housing the dilatometer. Alternatively, instead of the chamber 2 and the compression means 3 for the fluid contained in said chamber, the device (probe 100A) could comprise a vessel (chamber) 2A (FIG. 4) of pressurized fluid, for example a gas, and valve means 3A for controlling the pressure and flow of gas from the vessel 3A to the dilatometer and to the membrane 11. The valve means 3A are controlled by the unit 4 such as to achieve a device operation similar to that previously described. It should be noted that the use of a substantially incompressible liquid in the device, such as actuator oil, is preferred to gas as the risk of overinflating the membrane is reduced, as is hence the risk of membrane rupture.

The examples and the lists of possible variants of the present application are to be considered as non-exclusive examples.

The invention claimed is:

1. An in situ measurement device for soil investigation comprising a probe for inserting into and made to advance into ground, said probe comprising at least the following components:

at least one dilatometer presenting at least one expandable membrane, a chamber for a fluid to be fed to said dilatometer and expand said membrane, fluid pressure regulator means connected to said chamber and to said dilatometer, to generate and/or regulate the pressure of said fluid as pressurized fluid, a measurement device control unit for controlling said fluid pressure regulator means and said dilatometer;

electrical powering means to power at least said dilatometer, pressure regulator means, control unit, and pressure measurement means, memory means for storing at least one plurality of pressure values, measured by the pressure measurement means, for the fluid fed to said dilatometer, said components being all housed within said probe, said probe being a closed body without connections to the outside for feeding said pressurized fluid to said dilatometer and/or for feeding control signals for the device, said chamber being the only fluid feed source for said dilatometer.

2. A device as claimed in claim 1, wherein the control unit comprises a microprocessor having at least one timer for controlling the beginning and end of a plurality of predetermined time periods for the operation at least of said pressure regulator means.

3. A device as claimed in claim 2, wherein the control unit timer, at predetermined times and with predefined periodicity:

regulates the activation of the fluid pressure regulator means, and determines measurement of the pressure of said fluid as a function of the position of the dilatometer membrane.

4. A device as claimed in claim 1, wherein the fluid is a substantially incompressible liquid.

5. A device as claimed in claim 1, wherein the fluid pressure regulator means comprise a piston connected to a driver member arranged to drive the piston within the chamber, to pressurize the fluid contained therein and to exert the desired pressure on the membrane.

6. A device as claimed in claim 5, wherein the driver member comprises a worm.

7. A measurement system for investigating terrains or seabeds, comprising:

a measurement device of claim 1;

driver means for driving said device and causing the device to penetrate into the terrain or seabed and bringing the device into a plurality of predetermined test depths, at least two timer means: first timer means located on the measurement device, second timer means associated with said driver means for the measurement device;

said first and second timer means being mutually synchronized to enable predetermined alternation between device advancement periods and periods in which the device executes a test.

8. A system as claimed in claim 7, wherein the driver means has a driver control unit, wherein said first and second timer means are mutually synchronized to both feed to the respective control units a signal relative to a shared time measurement.

9. A system as claimed in claim 7, wherein the driver means has a driver control unit, wherein the control unit for the driver means comprises a memory which memorizes those time periods in which the measurement device can be advanced and those in which the measurement device makes the test, such that once the driver means have brought the device to a first desired test depth, or have driven the measurement device for a predetermined time period, said driver means are stopped to maintain the measurement device at said first depth, and then await that time period in which the device automatically makes the test.

10. A system as claimed in claim 7, wherein the driver means for the measurement device are for lowering onto the seabed.

11. A system as claimed in claim 7, wherein the driver means for the measurement device comprises a wireline.

12. A method for examining ground, terrains or seabeds, using a measurement system in accordance with claim 7, comprising a step in which the device, automatically, in a first plurality of predetermined predefined time instants, is made to penetrate into the terrain to the depth at which the measurements are to be made, said advancement then being halted, and a step in which, in a second plurality of predetermined predefined time instants, without any control originating from outside of the device, the fluid pressure regulator means are automatically activated to inflate the membrane of the dilatometer, a step in which at least two pressure values are automatically acquired for the compressed fluid and hence for the ground which counterbalances its thrust on the membrane, and a step in which, having acquired said values, said membrane is automatically deflated.

13. A method of use of a measurement system according to claim 7, comprising lowering the driver means for the measurement device onto the seabed, then automatically operating said driver means and said device when resting on said seabed, without any connection to units for their control and/or feed which do not rest on the seabed.

14. A method for examining ground, terrains or seabeds, using a device in accordance with claim 1, comprising:

advancing the device to penetrate into the terrain to depths at which the measurements are to be made, said advancement of the device is halted at said depths and, without any control originating from outside of the device, the fluid pressure regulator means are automatically activated to inflate the membrane of the dilatometer, automatically acquiring at least two pressure values for the compressed fluid and hence for the ground which counterbalances its thrust on the membrane, and having acquired said values, said membrane is automatically deflated.

15. A method as claimed in claim 14, wherein the device, at a plurality of predetermined instants, is arranged to automatically:

activate/deactivate the fluid pressure regulator means, measure the fluid pressure as a function of the position of the dilatometer membrane.

16. A device as claimed in claim 1, wherein the control unit comprises a microprocessor having a timer integrated into the control unit which, at predetermined times and with predefined periodicity:

regulates the activation of the fluid pressure regulator means, and determines measurement of the pressure of said fluid as a function of the position of the dilatometer membrane.

17. A device as claimed in claim 1, wherein the fluid is hydraulic actuator oil.

18. A measurement system for investigating terrains or seabeds, comprising:

a measurement device of claim 1;

driver means for driving said device and cause the device to penetrate into the terrain or seabed and bring the device into a plurality of predetermined test depths, at least two timer means: first timer means located on the measurement device, second timer means associated with said driver means for the measurement device and integrated into a control unit of the driver means; said first and second timer means being mutually synchronized to enable predetermined alternation between device advancement periods and periods in which the device executes a test.

* * * * *